United States Patent [19]

Pailler

[11] Patent Number: 4,556,334

[45] Date of Patent: Dec. 3, 1985

[54] UNITARY GUIDE FOR PLATEN AND PRINT HEAD

[75] Inventor: Alain L. N. Pailler, Bourg la Reine, France

[73] Assignee: Electronique Serge Dassault, Paris, France

[21] Appl. No.: 672,185

[22] Filed: Nov. 16, 1984

[30] Foreign Application Priority Data

Jun. 29, 1984 [FR] France ..... 84 10380

[51] Int. Cl.[4] ..... B41J 11/22; B41J 25/28

[52] U.S. Cl. ..... 400/124; 400/320; 400/354

[58] Field of Search ..... 400/354, 354.1, 320, 400/635, 124

[56] References Cited

U.S. PATENT DOCUMENTS 3,684,076 8/1972 Crain et al. ..... 400/635 X
4,044,881 8/1977 Chai et al. ..... 400/320 X
4,196,665 4/1980 Rogers et al. ..... 101/66

FOREIGN PATENT DOCUMENTS 947737 5/1974 Canada .
30271 6/1981 European Pat. Off. ..... 400/320
118885 9/1980 Japan ..... 400/635

OTHER PUBLICATIONS

Olson, et al., "Supporting Rail Structure for Matrix Printhead", *IBM Technical Disclosure Bulletin,* vol. 25, No. 5, Oct. 1982, pp. 2661–2662.

*Primary Examiner*—Clifford D. Crowder
*Attorney, Agent, or Firm*—Christie, Parker & Hale

[57] ABSTRACT

The printer is for printing on a narrow print-receiving medium such as a ticket (T) which passes lengthwise through the printer. The printer includes an anvil or platen which is at least partially constituted by a cylindrical roller (150) capable of rotating about its own axis (322) in such a manner that its cylindrical surface accompanies the movement of the narrow medium substantially without slipping. A dot-matrix print head is movable in translation transversely to the motion of the medium so as to print thereon against a generator line of the roller. The improvement lies in the printer further including a unitary guide assembly (301, 302, 307, 313) for guiding both rotation of the roller and translation of the print head.

18 Claims, 3 Drawing Figures

UNITARY GUIDE FOR PLATEN AND PRINT HEAD

FIELD OF THE INVENTION

The present invention relates to a printer for printing on a narrow medium such as a travel ticket or the like, and to ticket processing apparatus including such a printer.

More precisely, the invention relates to a printer through which the narrow medium passes lengthwise, the printer including an anvil or platen which is at least partially constituted by a cylindrical roller capable of rotating about its own axis in such a manner that its cylindrical surface accompanies the movement of the narrow medium substantially without slipping, and a dot-matrix print head which is movable in translation transversely to the motion of the medium so as to print thereon against a generator line of the roller.

BACKGROUND OF THE INVENTION

Proper operation of a dot-matrix print head requires the distance between the head and the print surface to be kept accurately constant. The head must therefore be guided in translation with high accuracy so that its distance from the facing generator line of the roller cylinder remains constant for all positions of the head.

Preferred embodiments of the present invention provide simple and effective means for ensuring such guidance.

SUMMARY OF THE INVENTION

According to the invention, this is achieved by the printer including a unitary guide assembly for guiding both rotation of the roller and translation of the print head.

Preferably, the unitary guide assembly includes a head-guiding slide surface which is circularly cylindrical and coaxial with the roller. The slide surface may be the surface of a bore of a fixed shaft on which the roller is mounted, with a bar that is fixed to the print head sliding in the bore.

In one embodiment, the bar has a rack of teeth which cooperate with at least one motor-driven pinion for the purpose of moving the print head in translation.

Preferably, the unitary guide assembly includes means independent from the said slide surface for ensuring a constant angular position of the print head relative to the roller axis. These independent means may comprise rotary wheels co-operating with a rod which is fixed to the print head and which extends in the direction of translation thereof.

The invention also provides apparatus for processing tickets, such as travel tickets and the like, which apparatus includes a printer as defined above for printing on the tickets.

Such apparatus may include at least one belt co-operating with a ticket over a portion of the ticket width to drive the ticket along an internal path through the apparatus, and the roller may include a notch in its surface to receive the belt in such a manner that the surface of the received belt is level with the remainder of the surface of the roller facing the print head.

BRIEF DESCRIPTION OF THE DRAWINGS

An embodiment of the invention is described by way of example with reference to the accompanying drawings, in which.

DETAILED DESCRIPTION OF THE PREFERRED EMBODIMENTS

Figure 1:
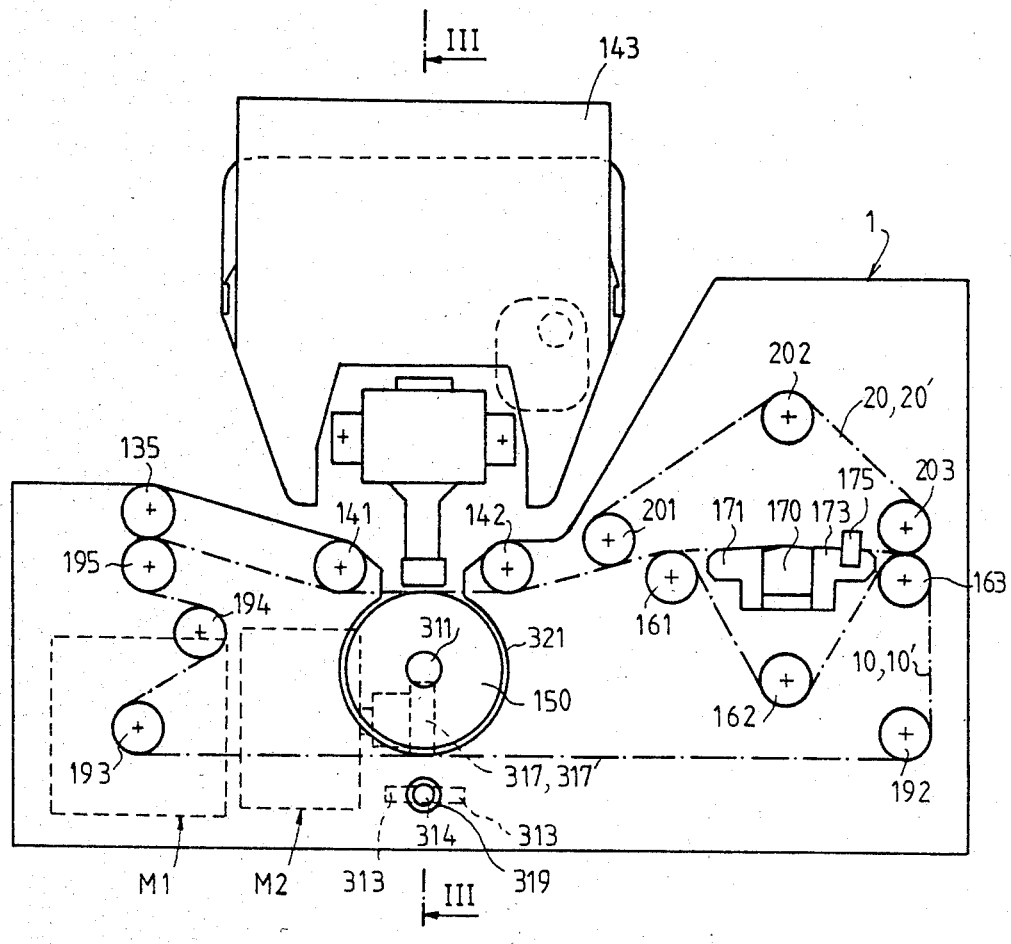
FIG. 1 is a diagrammatic elevation view of ticket processing apparatus in accordance with the invention.

The apparatus shown disgrammatically in FIG. 1 is intended to process travel tickets constituted by a paper or card based medium suitable for storing printed information and magnetically recorded data. Such processing may comprise printing and/or magnetic recording and/or maanetic reading, and may be for the purposes of creating a new ticket from a ticket blank, of inspecting a previously-created ticket, and of invalidating a used ticket.

The ticket follows an internal path through the apparatus running from an inlet defined by two wheels 135 and 195 to an outlet defined by two wheels 163 and 203.

Figure 3:
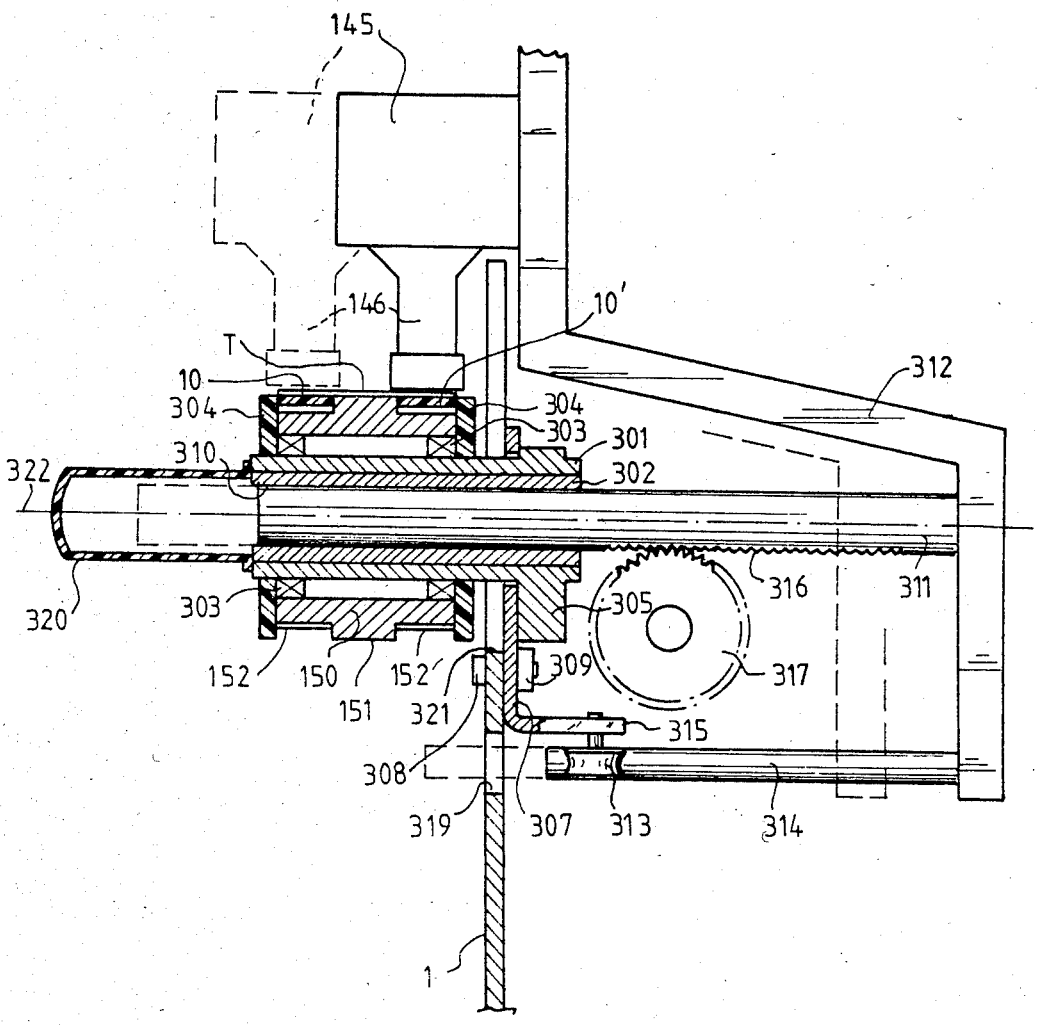
FIG. 3 is a part section on a line marked III-III in FIG. 1.

The ticket is driven along the internal path by a pair of parallel notched belts 10 and 10' which are spaced apart widthwise, and which engage respective fractions of the width of a ticket T as can be seen in FIG. 3.

The belts 10 and 10' pass over a wheel 193 which is driven by a motor M1, then a wheel 194, and then between the wheels 135 and 195. They are then kept taut by wheels 141 and 142 as they pass through a printer which is described in greater detail below. The belts are then deflected from the internal path by a wheel 161 to pass round a wheel 162 before returning to the internal path at the wheels 163 and 203. Finally a wheel 192 serves to return the belts to the drive wheel 193.

The detour round the wheels 161, 162 and 163 leaves room to insert a magnetic head 170 on the internal path. The magnetic head is accompanied by a ticket detector 175 and by flanking portions of plate 171 and 173. A second pair of belts 20 and 20' is provided over the plate, which belts pass round wheels 201 and 203 situated on the internal path and round a return wheel 202 situated off the internal path. The belts 20 and 20' co-operate with the upper faces of the tickets while the belts 10 and 10' co-operate with their lower faces. Means, not shown, serve to keep the belts under tension.

The wheels and the motor M1 are mounted on a frame which is constituted by a vertical plate 1.

Other details of the apparatus may be found in the applicants' co-pending U.S. Pat. No. 4,537,125 and in co-pending U.S. Ser. No. 672,184 filed Nov. 16, 1984. The description of these above-identified Applications is considered to be incorporated in the present Application.

The support means in the form of an anvil or platen of the printer is constituted by the belts 10 and 10' co-operating with a platen roller 150 which is generally cylindrical in shape. It can be seen in FIG. 3 that the roller 150 has a generally smooth middle portion 151 flanked by corrugated notches 152 and 152' for receiving the notched faces of the belts 10 and 10' respectively. The dimensions are chosen so that the smooth faces of the belts adjacent to the tickets lie level with the surface of the middle portion 151 of the roller. However, the invention is not restricted to this particular arrangement, and could be applied, for example, equally well to a system in which belts were not used at all for driving tickets along the internal path.

The information recording means in the form of a dot matrix print head has a base 145 and a print needle guide 146 which are both shown diagrammatically in FIG. 3. The head is mounted to print on the ticket T along the facing generator line of the roller. An ink ribbon cartridge 143 is fixed to the print head (see FIG. 1).

Figure 2:
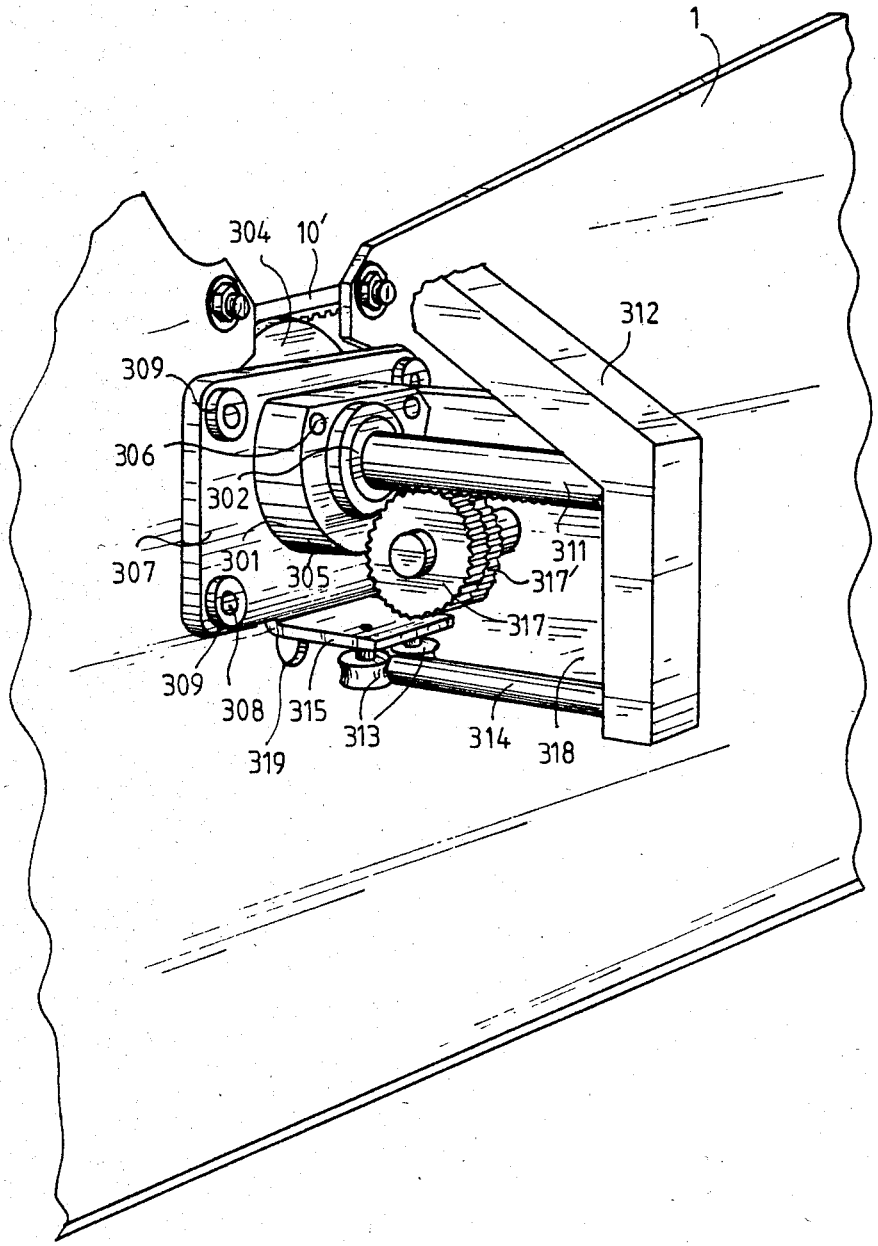
FIG. 2 is a perspective view of a portion of the apparatus.

In accordance with the invention, a unitary guide assembly is provided for guiding both the rotation of the platen roller 150 and the translation motion of the print head. This guide assembly comprises a fixed hollow shaft in the form of a sheath 301 and a sleeve 302 received in the sheath. The roller cylinder is mounted on the outside of the sheath by means of ball bearings 303. Plastic material cheek pieces 304 are fitted around the sheath and are screwed to respective sides of the platen roller 150. One of the ends of the sheath is surrounded by a generally circular flange plate 305 which is screwed by means of screws 306 to a rear face of a generally rectangular base plate 307 which is itself screwed to the rear of the frame 1 by screws 308 received in bosses 309 on the base plate 307. The terms "front" and "rear" are used in such a manner that FIG. 1 is looking at the front of the frame 1, FIG. 2 is looking at the rear of the frame 1, and in FIG. 3, the front is to the left of the figure while the rear is to the right of the figure.

The shaft 301, 302 passes through the frame plate 1 and the base plate 307 and supports the platen roller 150 in cantilever fashion. The shaft has a bore with a circularly cylindrical surface 310 which is coaxial with the roller 150 and which is capable of receiving a bar 311 suitable for sliding along the bore. One end of the bar 311 has a bracket 312 fixed thereto for supporting the print head 145, 146 (the top of the bracket and the print head are removed in FIG. 2.

Thus, as the bar 311 slides in the bore along the shaft 301, 302, the print head is accurately guided along a generator line of the platen roller 150 in such a manner that the distance between the print head and the anvil or platen surface facing it remains constant regardless of the position of the print head over the platen.

To prevent the bar 311 from rotating about the common axis 322 of the bore 310 and the platen roller 150, and consequently to prevent the print head from rotating, angle positioning means are provided independent of the slide surface 310. These angle positioning means comprise a pair of wheels 313 mounted on either side of and co-operating with a rod 314 which is fixed to the bracket 312. The rod is located below the bar 311 and the wheels 313 rotate freely about vertical axes mounted on a horizontally projecting tongue 315 at the bottom of the base plate 307.

The bottom of the bar 311 has a rack of teeth 316 which co-operate with two pinions 317 and 317' mounted on a common shaft and driven by a stepper motor M2 which is mounted on a vertical plate 318 projecting rearwardly from the baseplate 307 (see FIGS. 1 and 2). One of the pinions is fixed to the motor shaft, while the other is resiliently connected to the first in such a manner as to take up any slack or backlash between the teeth of the rack and the teeth of the pinions. This ensures extremely accurate positioning of the print head in the translation direction, i.e. across the width of a ticket T.

Some components which are movable in translation are shown twice over in FIG. 3. Continuous lines are used for their rearmost position, while dashed lines are used to indicate their foremost printing position. They can be moved even further forward in order to change the ribbon. An orifice 319 is made through the frame plate 1 to allow the rod 314 to pass through. A larger hole 321 is also provided in the frame plate 1 in order to mount the entire unitary assembly. A cover or cap 320 is mounted on the front end of the shaft 301, 302 in order to cover the front end of the bar 311 when it projects out from the shaft.

I claim:

1. A printer for printing on a narrow print-receiving medium to be passed in a lengthwise direction through the printer, the printer comprising:

supporting means comprising a cylindrical roller having a cylindrical surface, the roller being rotatable about an axis thereof whereby the cylindrical surface moves with the medium substantially without slipping in relation to the medium;

a dot matrix print head movable in translation transversely to the lengthwise motion of the medium for printing on the medium along a line on the roller; and a unitary guide assembly for guiding both the rotation of the roller and translation of the print head and comprising a head-guiding circularly cylindrical slide surface coaxial with the roller.

2. The printer as claimed in claim 1 wherein the support means comprises a platen.

3. The printer as claimed in claim 1 wherein the print head comprises a bar fixed to the print head and the roller comprises a bore for accepting a fixed shaft having a surface, wherein the slide surface comprises the surface of the bore and the bar is mounted in the bore.

4. The printer as claimed in claim 3 further comprising ball bearings for mounting the roller on the fixed shaft.

5. The printer as claimed in claim 3 wherein the bar comprises a rack of teeth cooperating with at least one motor-driven pinion for moving the print head.

6. The printer as claimed in claim 5 wherein two pinions are juxtaposed on a single drive shaft with means for clamping a tooth of the rack between teeth of the two pinions to provide backlash-free positioning in translation of the print head.

7. The printer as claimed in claim 3 wherein the unitary guide assembly includes means independent of the slide surface for ensuring a constant angular position of the print head relative to the roller axis.

8. The printer as claimed in claim 7 further comprising a rod fixed to the print head extending in the direction of translation thereof and wherein the independent means comprises rotary wheels cooperating with the rod.

9. The printer as claimed in claim 8 further comprising a common base plate wherein the shaft of the roller and the rotary wheels are mounted on the common base plate.

10. An apparatus for processing tickets comprising a printer for printing on a narrow print-receiving medium to be passed in a lengthwise direction through the apparatus wherein the printer comprises:

supporting means comprising a cylindrical roller having a cylindrical surface, the roller being rotatable about an axis thereof whereby the cylindrical surface moves with the medium substantially without slipping in relation to the medium;

a dot matrix print head movable in translation transversely to the lengthwise motion of the medium for printing on the medium along a line on the roller; and a unitary guide assembly for guiding both the rotation of the roller and translation of the print head and comprising a head-guiding circularly cylindrical slide surface coaxial with the roller.

11. The apparatus as claimed in claim 10 wherein the supporting means comprises a platen.

12. The apparatus as claimed in claim 11 wherein the print head comprises a bar fixed to the print head and the roller comprises a bore for accepting a fixed shaft having a surface, wherein the slide surface comprises the surface of the bore and the bar is mounted in the bore.

13. The apparatus as claimed in claim 12 wherein the unitary guide assembly includes means independent of the slide surface for ensuring a constant angular position of the print head relative to the roller axis.

14. The apparatus as claimed in claim 13 further comprising a rod fixed to the print head extending in the direction of translation thereof and wherein the independent means comprises rotary wheels cooperating with the rod.

15. The apparatus as claimed in claim 14 further comprising a common base plate wherein the shaft of the roller and the rotary wheels are mounted on the common base plate.

16. The apparatus as claimed in claim 15 further comprising a frame comprising a plate, and wherein the base plate is fixed to the plate.

17. The apparatus as claimed in claim 16 comprising a belt having a face wherein the face is notched for engaging the roller, and wherein the roller comprises notches for receiving the belt comprising corrugations matching the notches of the belt.

18. A printer for printing on a print-receiving medium to be passed in a lengthwise direction through the printer, the printer comprising:

support means comprising a cylindrical roller having a cylindrical surface and an axis and rotatable about the axis whereby the cylindrical surface moves with the medium substantially without slipping;

information recording means movable transversely to the lengthwise direction for recording information; and guide means for guiding the support means and the recording means and comprising a guide surface interior to the roller for guiding the recording means.

* * * * *

UNITED STATES PATENT AND TRADEMARK OFFICE

CERTIFICATE OF CORRECTION

PATENT NO. : 4,556,334

DATED : December 3, 1985

INVENTOR(S) : ALAN LOUIS NOEL PAILLER

It is certified that error appears in the above-identified patent and that said Letters Patent is hereby corrected as shown below:

Column 2, line 15, "disgrammatically" should read --diagrammatically--.

Column 2, line 20, "maanetic" should read --magnetic--.

Signed and Sealed this

Seventh Day of October, 1986

[SEAL]

*Attest:*

DONALD J. QUIGG

*Attesting Officer*

*Commissioner of Patents and Trademarks*